US008956122B2

(12) United States Patent
Helmis et al.

(10) Patent No.: US 8,956,122 B2
(45) Date of Patent: Feb. 17, 2015

(54) BLADE FASTENING HAVING SAFETY DEVICE FOR TURBINE BLADES

(75) Inventors: Thomas Helmis, Mülheim an der Ruhr (DE); Heinrich Stüer, Haltern (DE)

(73) Assignee: Siemens Aktiengesellschaft, München (DE)

( * ) Notice: Subject to any disclaimer, the term of this patent is extended or adjusted under 35 U.S.C. 154(b) by 508 days.

(21) Appl. No.: 13/496,096

(22) PCT Filed: Sep. 17, 2010

(86) PCT No.: PCT/EP2010/063701

§ 371 (c)(1), (2), (4) Date: Mar. 14, 2012

(87) PCT Pub. No.: WO2011/033063

PCT Pub. Date: Mar. 24, 2011

(65) Prior Publication Data

US 2012/0177499 A1 Jul. 12, 2012

(30) Foreign Application Priority Data

Sep. 17, 2009 (EP) ..... 09011885

(51) Int. Cl.
*F01D 5/30* (2006.01)
*F01D 5/32* (2006.01)

(52) U.S. Cl.
CPC ..... *F01D 5/323* (2013.01); *F05B 2260/3011* (2013.01); *F05D 2260/30* (2013.01)
USPC ..... 416/221

(58) Field of Classification Search
CPC ..... F01D 5/3053; F01D 5/32; F01D 5/323; F01D 5/326
USPC ..... 416/220 R, 221
See application file for complete search history.

(56) References Cited

U.S. PATENT DOCUMENTS

| | | | | |
|---|---|---|---|---|
| 2,963,271 | A | 7/1956 | McCormick | |
| 5,443,366 | A | 8/1995 | Knott et al. | |
| 7,153,103 | B2 | 12/2006 | Farndon | |
| 7,467,925 | B2 | 12/2008 | Schröder | |
| 2009/0010762 | A1 | 1/2009 | Caucheteux et al. | |
| 2009/0324414 | A1 | 12/2009 | Helmis et al. | |
| 2011/0171031 | A1 | 7/2011 | Benkler et al. | |
| 2013/0216387 | A1 * | 8/2013 | Torkaman et al. | 416/220 R |

FOREIGN PATENT DOCUMENTS

| | | | |
|---|---|---|---|
| CN | 101294501 | A | 10/2008 |
| EP | 0597586 | A1 | 5/1994 |
| EP | 0712995 | A1 | 5/1996 |
| EP | 1619354 | A1 | 1/2006 |
| EP | 1892380 | A1 | 2/2008 |
| EP | 2090750 | A1 | 8/2009 |
| FR | 2323908 | A1 | 4/1997 |

(Continued)

*Primary Examiner* — Edward Look
*Assistant Examiner* — Danielle M Christensen

(57) ABSTRACT

A safety device for a turbine blade is provided. The safety device includes a shear pin, a clamping piece and a securing element, wherein the shear pin is arranged in a corresponding bore in the turbine blade foot and the clamping piece is designed having an upper limb and a lower limb, wherein the clamping piece exerts a radial force on the turbine blade foot for radial safeguarding.

8 Claims, 4 Drawing Sheets

(56) References Cited

FOREIGN PATENT DOCUMENTS

| | | | |
|---|---|---|---|
| GB | 402061 | | 11/1933 |
| GB | 2410531 | A | 8/2005 |
| WO | WO 2008037661 | A1 | 4/2008 |

* cited by examiner

BLADE FASTENING HAVING SAFETY DEVICE FOR TURBINE BLADES

CROSS REFERENCE TO RELATED APPLICATIONS

This application is the US National Stage of International Application No. PCT/EP2010/063701, filed Sep. 17, 2010 and claims the benefit thereof. The International Application claims the benefits of European Patent Office application No. 09011885.2 EP filed Sep. 17, 2009. All of the applications are incorporated by reference herein in their entirety.

FIELD OF INVENTION

The invention relates to a rotor comprising at least one turbine blade and a locking device for the axial and radial locking of the turbine blade, wherein the rotor comprises a blade groove and the turbine blade comprises a turbine blade root, wherein the blade groove and the turbine blade root are designed in such a way that the turbine blade root is fitted in the blade groove.

BACKGROUND OF INVENTION

Blade fastenings are usually used for the fastening of rotor blades on a rotor of a turbomachine, especially a steam turbine. As a result of the comparatively fast rotation of the rotor, the rotor blades which are arranged on the rotor are exposed to high centrifugal forces. The turbine blade root of the turbine blades must therefore withstand high forces and is pushed radially outward in the blade groove. In addition to the centrifugal forces, severe vibrational loads present a further problem which can result in mechanical damage, material fatigue, corrosion and a migratory movement of the blade root inside the blade groove. For fixing the turbine blade root inside the blade groove, various solutions, such as metal wedges, spring rings or sealing pieces, are known. Metal wedges certainly create a locking of the associated blade root inside a blade groove both axially and radially, but in the case of large rotor blades it is difficult to create sufficient retaining forces with such metal wedges during rotation in the radial direction. Disk springs create only radial retaining forces and necessitate additional expenditure for locking in the axial direction of the associated blade groove. Furthermore, complex measurements are necessary for disk springs during installation. As sealing pieces, provision must always be made for two parts, the installation of which, moreover, partially necessitates the machining of the parts by hand.

SUMMARY OF INVENTION

The invention is based on the object of providing a blade fastening for a turbomachine in which a precise and fixed retention of blades in associated blade holders is ensured over a long operating period.

This object is achieved by means of a rotor comprising at least one turbine blade according to the claims.

The locking device has a clamping piece which exerts a radial force from the rotor onto the turbine blade root. The clamping piece is arranged in this case in a groove which is located in the rotor, wherein the groove itself can be like the groove in which the shear pin is arranged. The size of the clamping piece is selected in such a way that a force is created, acting in the radial direction. This means that the turbine blade is pressed against the bearing flanks of the blade groove. Up to a certain rotational frequency, a movement of the blades in the groove is therefore effectively prevented. Beyond a certain rotational frequency, the centrifugal forces are of such magnitude that a movement is prevented as a result of the abutment against the bearing flanks. However, it is almost unavoidable that the turbine blade vibrates despite root fastening. The fastening according to the invention, moreover, prevents a relative movement between the turbine blade root and the blade groove, as a result of which surface damage is reduced.

Up to this rotational frequency, an axial displacement of the turbine blade is possible. Above the certain rotational frequency, the centrifugal forces are of such magnitude that an axial displacement is avoided, since the friction forces, which act as a consequence of the centrifugal force, effectively prevent a displacement of the turbine blade in the blade groove.

The clamping piece has an upper leg and a lower leg, wherein the upper leg butts against the turbine blade root and exerts a force against the turbine blade root in the radial direction. The lower leg butts against the rotor.

The invention is distinguished by the fact that the upper leg and the lower leg basically form a V-shape and by skilful material selection a spring force is exerted, acting from the rotor upon the turbine blade root in the radial direction.

In one advantageous development the shear pin butts against the lower leg.

Advantageous developments are disclosed in the dependent claims.

The invention is based on the idea that in a blade groove both radial and axial locking can be arranged. The shear pin is arranged in a corresponding hole in the turbine blade root and advantageously butts against an edge on the rotor. As a result, an axial movement of the turbine blade root is not possible. If a shear pin is arranged both on the leading edge and on the trailing edge of the turbine blade root in each case, then an axial displacement of the turbine blade root is effectively prevented both in the one direction and in the other direction.

The shear pin in this case is installed in a groove which is arranged in the rotor. The installation of the shear pin is carried out after the turbine blade has been installed in the rotor in the corresponding blade groove.

In order to avoid an unwanted loosening of the clamping piece, use is made of a locking element which is designed for locking the clamping piece. To this end, the clamping piece is designed as a locking plate and is arranged between the clamping piece and the rotor. By bending over the locking plate on the edge of the clamping piece, a displacement of the clamping piece is avoided, wherein at the same time the locking plate has to be arranged in a corresponding groove in the rotor.

BRIEF DESCRIPTION OF THE DRAWINGS

An exemplary embodiment of the solution according to the invention is subsequently explained in more detail with reference to the attached schematic drawings.

In the drawings.

DETAILED DESCRIPTION OF INVENTION

Figure 1:
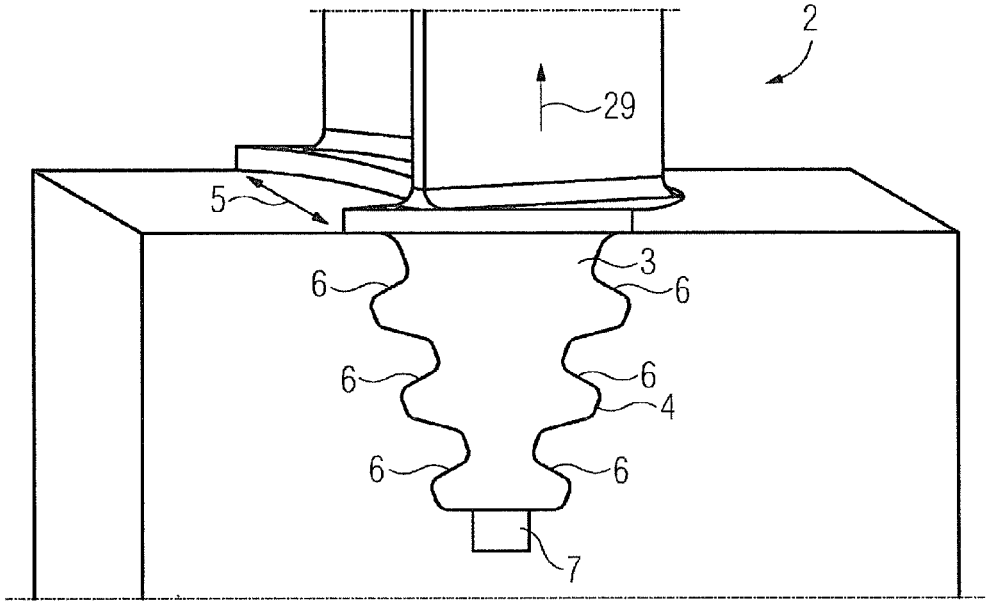
FIG. 1 shows a side view of a rotor with a turbine blade in the installed state.

FIG. 1 shows a side view of a part of a rotor 1 with an installed turbine blade 2. The turbine blade 2 has a turbine blade root 3 which is fitted into a corresponding blade groove 4. The turbine blade 2 is inserted into the blade groove 4 in the axial direction 5. The blade groove 4 is designed as a fir-tree blade groove and comprises a plurality of bearing flanks 6.

The turbine blade 2 is locked in the blade groove 4 both in the axial direction 5 and in the radial direction 29. The radial direction 29 basically corresponds to the longitudinal orientation of the turbine blade 2 and the axial direction 5 basically corresponds to the rotational axis, which is not shown in more detail in FIG. 1.

For locking the turbine blade 2, a locking device 7, which is arranged beneath the turbine blade root 3, is implemented. The turbine blade root 3 is designed in this case in such a way that this is fitted into the blade groove 4, i.e. can basically move in the axial direction 5.

Figure 2:
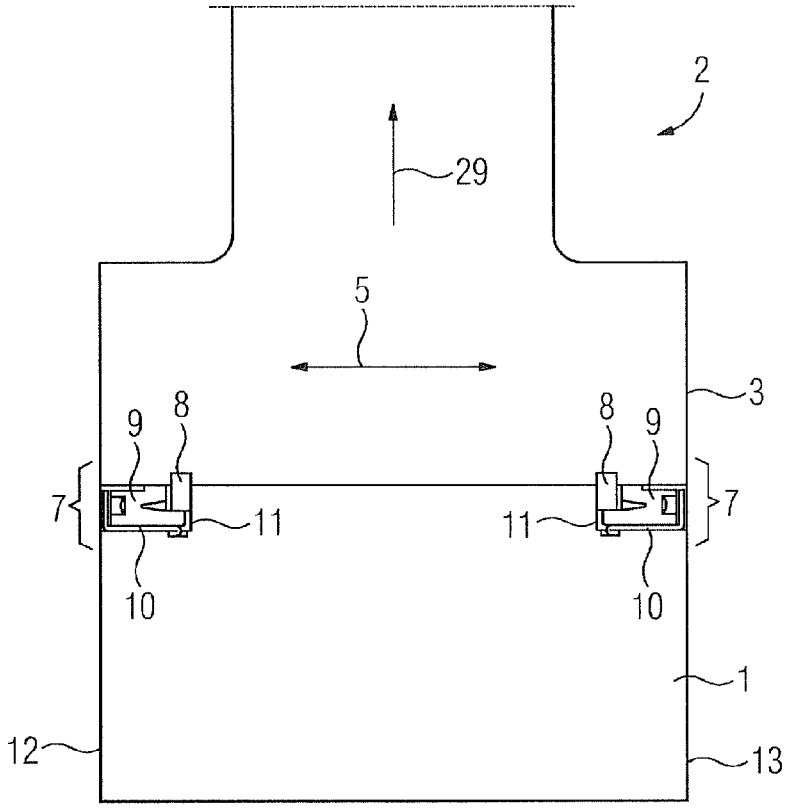
FIG. 2 shows a cross-sectional view of a part of a rotor with installed turbine blade.

In FIG. 2, a sectional view through a part of the rotor 1 is shown. The locking device 7 in essence comprises three components. These would be, on the one hand, a shear pin 8, a clamping piece 9 and a locking element 10. The locking device 7 is arranged in a corresponding groove 11 in the rotor 1. This groove 11 is formed both on the steam inlet side 12 and on the steam exit side 13. The installation of at least two locking devices 7, i.e. both on the steam inlet side 12 and on the steam exit side 13, offers the advantage that the turbine blade 2 can no longer move in the axial direction 5. The principle of operation and also the installation of the locking device 7 are explained in more detail with reference to FIG. 3.

The shear pin 8 is of a cylindrical design and has a length L which is less than the height 14 of the groove 11. As a result, a problem-free insertion of the shear pin 8 into the groove 11 is possible. The shear pin 8 is introduced into a hole 15 which is located in the blade root 3. The hole 15 and the groove 11 in this case are designed in such a way that in the installed state the shear pin 8 butts against an edge 16 in the rotor 1. A displacement of the turbine blade root 3 in the axial direction 5 is therefore no longer possible.

Figure 4:
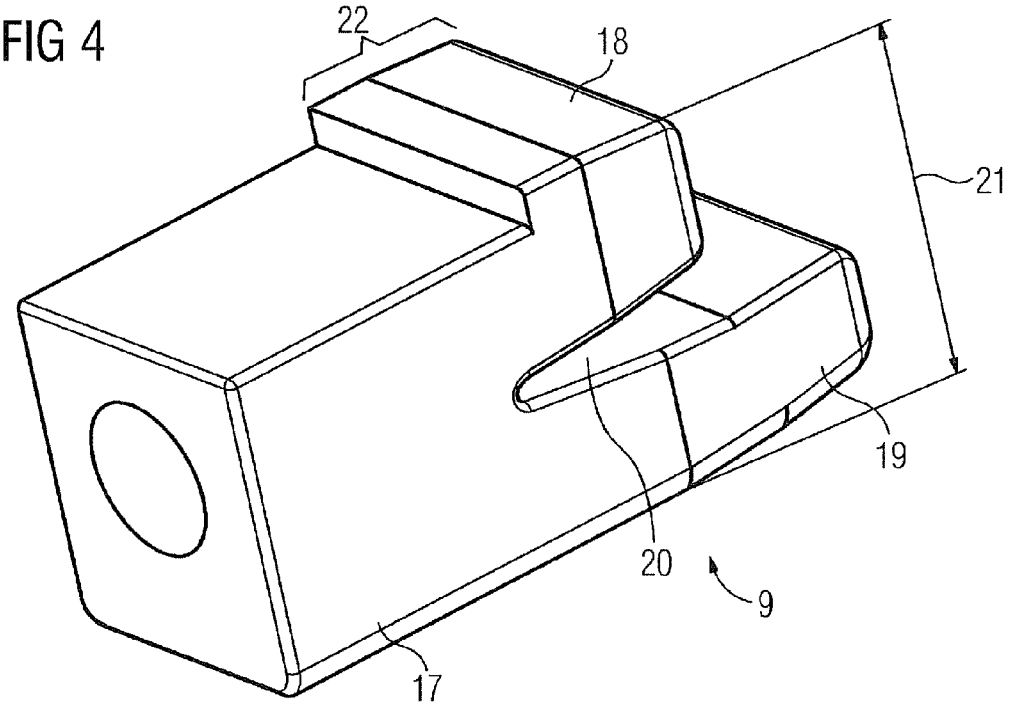
FIG. 4 shows an enlarged view of a clamping piece.
Figure 5:
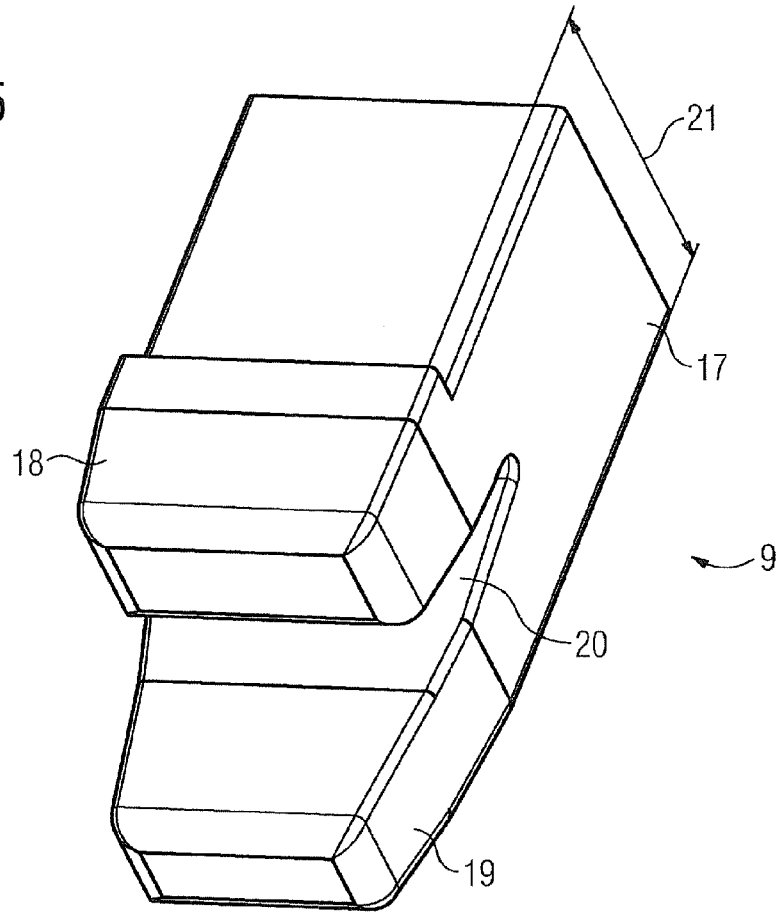
FIG. 5 shows a perspective view of the clamping piece.

A further element of the locking device 7 forms the clamping piece 9. In FIGS. 4 and 5, a perspective and enlarged view of the clamping piece 9 is to be seen. In essence, the clamping piece 9 is constructed with a basic body 17, which is of a cubic design, and with an upper leg 18 and a lower leg 19. Between the upper leg 18 and the lower leg 19 a gap 20 is formed. The dimensions of the clamping piece 9 are selected in such a way that the height 21 of the clamping piece 9 is less than the height 14 of the groove. Inserting the clamping piece 9 into the blade groove 4 is therefore possible without any problem. The dimensions are also selected in such a way that in the installed state the upper leg 18 presses a force, which is similar to a spring force, against the turbine blade root 3. The upper leg 18 has a projection 22 for this, which is about a third of the length of the clamping piece 9. Both the upper leg 18 and the lower leg 19 are of a wedge-like construction, i.e. the upper leg 18 and the lower leg 19 taper from the basic body 17 in the direction of the legs 18, 19.

Figure 3:
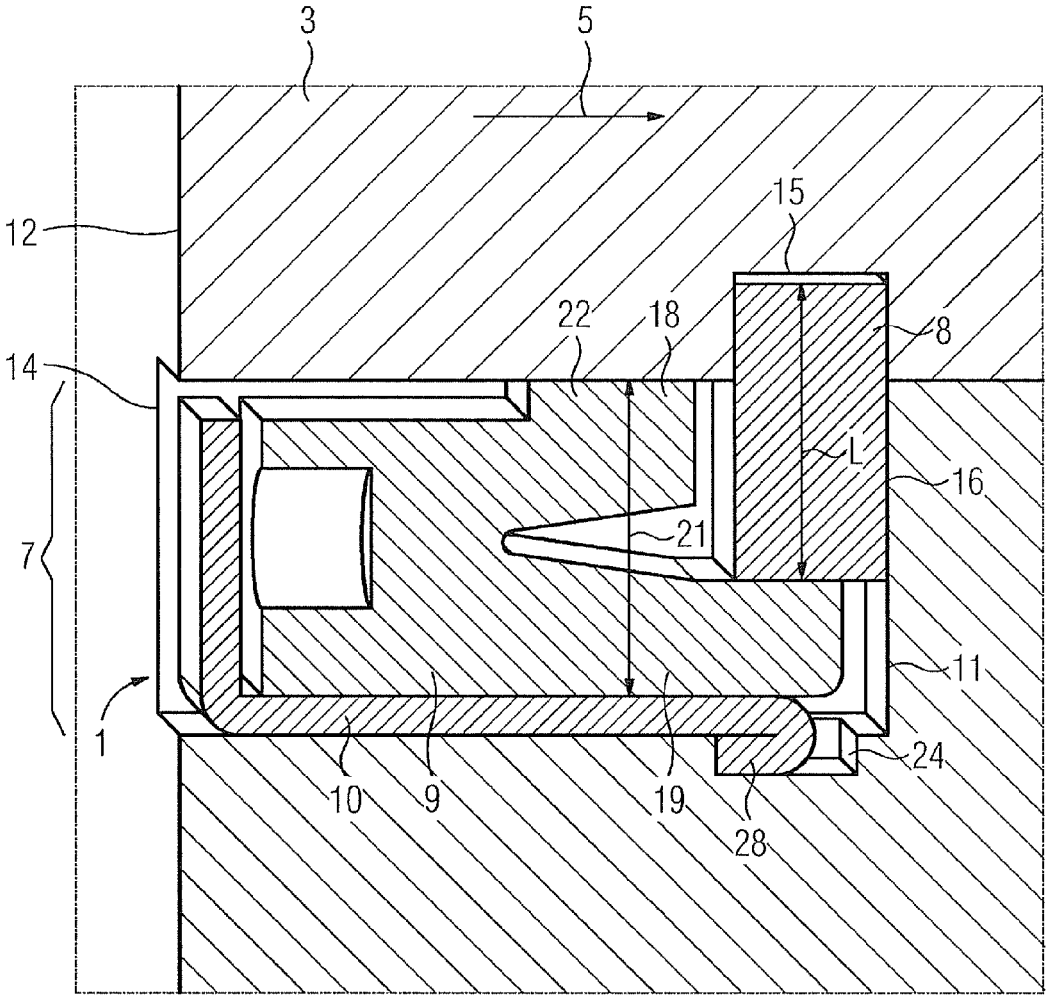
FIG. 3 shows an enlarged view of a detail from FIG. 2.
Figure 6:
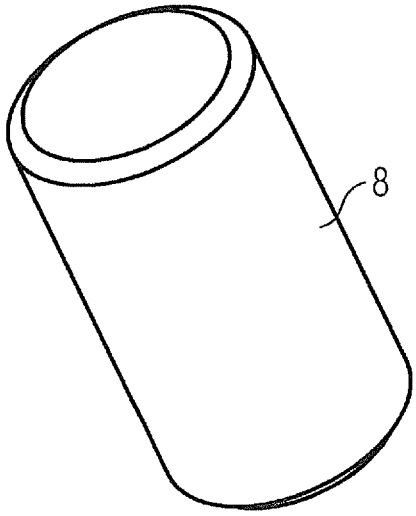
FIG. 6 shows a perspective view of a shear pin.
Figure 7:
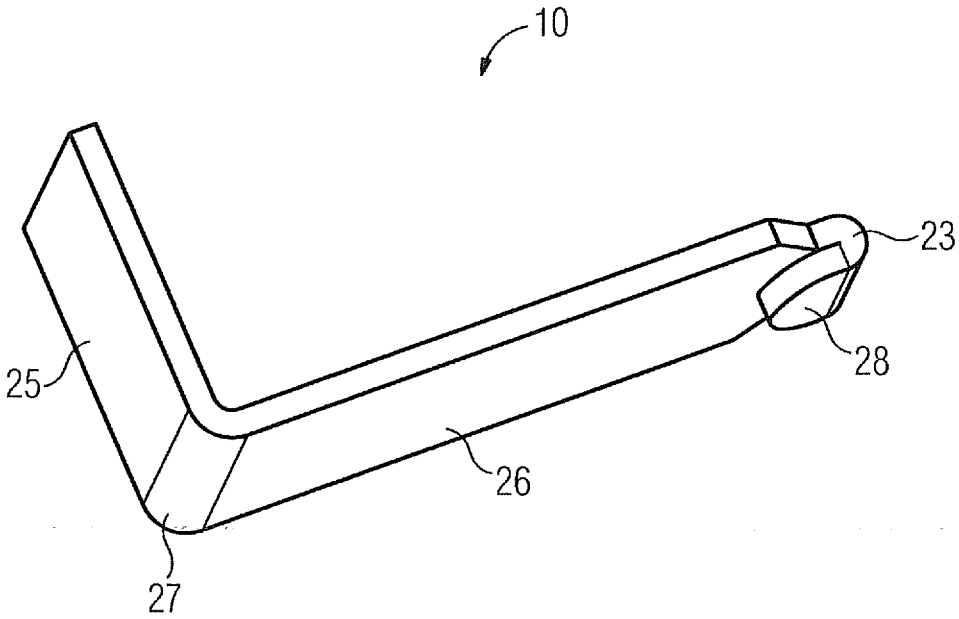
FIG. 7 shows a perspective view of a locking element.

FIG. 6 shows a perspective view of the shear pin 8. A third element of the locking device 7 is the locking element 10 which is constructed as a locking plate. The locking element 10 is explained in more detail with reference to FIG. 7. In essence, the locking element 10 is designed as a sheet metal piece of an elongated form which is completely folded over once at its tip 23, as a result of which a projection 28 is created. In the installed state, this projection 28 lies in a corresponding locking groove 24. As shown in FIG. 3, an axial displacement 5 of the locking element 10 is effectively avoided as a result. Furthermore, the locking element 10 has an end piece 26 which, in relation to a main piece 25, is bent perpendicularly at the bending point 27.

The locking device 7 is now installed as follows: First of all, the turbine blade 2 is introduced into the corresponding blade groove 4. Next, the shear pin 8 is fitted into the corresponding hole 15. The locking element 10 is inserted in the unbent state and at the tip 23 has a projection 28 which is arranged in a corresponding locking groove 24. The clamping piece 9 is pushed onto the locking element 10 into the groove 11 in such a way that the shear pin 8 butts against the lower leg 19. The possibility of the shear pin 8 falling out of the hole 15 is consequently avoided. The locking element 10 is inserted in the unbent state and at the tip 23 has a projection 28 which is arranged in a corresponding locking groove 24. The locking element 10 is finally bent at the bending point 27, as a result of which the possibility of the clamping piece 9 falling out of the groove 11 is effectively avoided.

The invention claimed is:

1. A rotor, comprising:
- a turbine blade;
- a locking device for the axial and radial locking of the turbine blade;
- a blade groove,
- wherein the turbine blade comprises a turbine blade root,
- wherein the blade groove and the turbine blade root are designed in such a way that the turbine blade root is fitted in the blade groove,
- wherein the locking device includes a shear pin which projects into a hole in the turbine blade root,
- wherein a clamping piece is arranged in a groove which is located in the rotor,
- wherein the clamping piece has an upper leg and a lower leg,
- wherein the upper leg butts against the turbine blade root and exerts a force against the turbine blade root in the radial direction,
- wherein the lower leg butts against the rotor and exerts a force against the rotor in the radial direction,
- wherein the upper leg and the lower leg are of a V-shaped design, and
- wherein the shear pin butts against the lower leg.

2. The rotor as claimed in claim 1, wherein the rotor includes an edge against which the shear pin butts.

3. The rotor as claimed in claim 1,
- wherein the locking device includes a clamping piece which exerts a radial force from the rotor onto the turbine blade root.

4. The rotor as claimed in claim 2, wherein the locking device includes a clamping piece which exerts a radial force from the rotor onto the turbine blade root.

5. The rotor as claimed in claim 1,
- wherein the locking device includes a locking element for locking the clamping piece.

6. The rotor as claimed in claim 5,
- wherein the locking element is designed as a locking plate which is arranged between the clamping piece and the rotor.

7. The rotor as claimed in claim 5,
- wherein the locking element has a projection which is arranged in a locking groove which is located in the rotor.

8. The rotor as claimed in claim 6,
- wherein the locking element has a projection which is arranged in a locking groove which is located in the rotor.

* * * * *